US011584612B2

(12) United States Patent
Weaver

(10) Patent No.: US 11,584,612 B2
(45) Date of Patent: Feb. 21, 2023

(54) HOSE DISPENSING SYSTEM

(71) Applicant: New Heights, LLC, Leola, PA (US)

(72) Inventor: Jeremiah Weaver, Narvon, PA (US)

(73) Assignee: New Heights, LLC, Leola, PA (US)

( * ) Notice: Subject to any disclaimer, the term of this patent is extended or adjusted under 35 U.S.C. 154(b) by 154 days.

(21) Appl. No.: 17/095,902

(22) Filed: Nov. 12, 2020

(65) Prior Publication Data

US 2022/0144582 A1 May 12, 2022

(51) Int. Cl.
*B65H 75/18* (2006.01)
*B65H 75/44* (2006.01)

(52) U.S. Cl.
CPC ..... *B65H 75/4478* (2013.01); *B65H 75/182* (2013.01); *B65H 75/4402* (2013.01)

(58) Field of Classification Search
CPC ..... B65H 75/182; B65H 75/4402; B65H 75/4478; B65H 49/32; A47F 7/005
See application file for complete search history.

(56) References Cited

U.S. PATENT DOCUMENTS 1,566,950 A * 12/1925 Yushka ..... B65H 49/32 242/129.6
1,818,518 A * 8/1931 Jacob ..... A47F 7/005 242/598.5
5,109,882 A * 5/1992 Eley ..... B65H 75/4463 137/355.27
7,784,729 B1 * 8/2010 Hope ..... B65H 49/32 242/597.4
8,413,824 B2 * 4/2013 Cabassa ..... B62B 3/104 211/85.15

* cited by examiner

*Primary Examiner* — Sang K Kim
(74) *Attorney, Agent, or Firm* — Barley Snyder

(57) ABSTRACT

A system for dispensing a flexible hose includes a hose dispensing carousel having a frame, a spool support plate rotatably mounted to the frame and having a plurality of spool axles for rotatably supporting a plurality of spools of hose, and a lock adapted to fix a position of the spool support plate relative to the frame in a plurality of discrete positions. The system further includes a guide defining an opening adapted to receive a free end of a hose held on one of the plurality of spools. The guide defines at least one rotatable bearing surface positioned at the opening, and is adapted to guide the hose toward a tool for performing a manufacturing operation on the hose.

19 Claims, 17 Drawing Sheets

HOSE DISPENSING SYSTEM

FIELD OF THE INVENTION

The present disclosure relates to material handling equipment, and more particularly, to a system for organizing and dispensing materials packaged on spools or reels, such as hoses or other flexible conduits.

BACKGROUND

Hose assemblies, such as those used in the delivery of various fluids (e.g., hydraulic fluid, fuel, water, etc.) are widely used throughout many industries and in countless varying applications. Such diversity creates a need to be able to efficiently manufacture unique, application-specific assemblies in small quantities. For example, assemblies may utilize hoses of varying sizes (e.g., diameters, wall thicknesses, and overall length), material construction, end-fitting types depending on the application. Further, these hoses and other flexible materials often come packaged in bulk, and are wound on spools or reels making them heavy and difficult to handle. These characteristics result in time consuming and labor intensive changeover when switching between manufacturing assemblies utilizing different hose types.

Accordingly, there is need for solutions which increase the ease and efficiency by which hoses and other flexible materials or conduits may be stored, accessed and manipulated during associated manufacturing processes.

SUMMARY

In one embodiment of the present disclosure, a system for dispensing a flexible hose is provided. The system includes a hose dispensing carousel having a frame, a spool support plate rotatably mounted to the frame and having a plurality of spool axles for rotatably supporting a plurality of spools of hose, and a lock adapted to fix the spool support plate relative to the frame in a plurality of discrete positions. The system further includes a guide defining an opening adapted to receive a free end of a hose held on one of the plurality of spools. The guide defines at least one rotatable bearing surface positioned at the opening, and is configured to align the hose with, and guide the hose toward, a tool for performing a manufacturing operation thereon.

In another embodiment, a hose dispensing carousel includes a frame and a spool support plate rotatably mounted to the frame. A plurality of spool axles are mounted to the spool support plate, with a plurality of spools each selectively rotatably mounted on a respective one of the plurality of spool axles. A plurality of fasteners are provided, with each configured to fix a respective spool relative to a respective spool axle. The carousel further comprises a lock adapted to fix a position of the spool support plate relative to the frame in a plurality of discrete positions.

Other objects and advantages of the present invention will be apparent by the following description with reference to the accompanying drawings and will be helpful for a comprehensive understanding to the present invention.

BRIEF DESCRIPTION OF THE DRAWINGS

The above and other features of the disclosure will become more apparent by describing in detail exemplary embodiments thereof with reference to the accompanying drawings, in which:

FIG. 9 is a rear perspective view of a user-actuated lock for fixing the rotational position of the spool support plate of FIG. 7 relative to a remainder of the hose dispensing carousel;

DETAILED DESCRIPTION OF THE EMBODIMENTS

Figure 1:
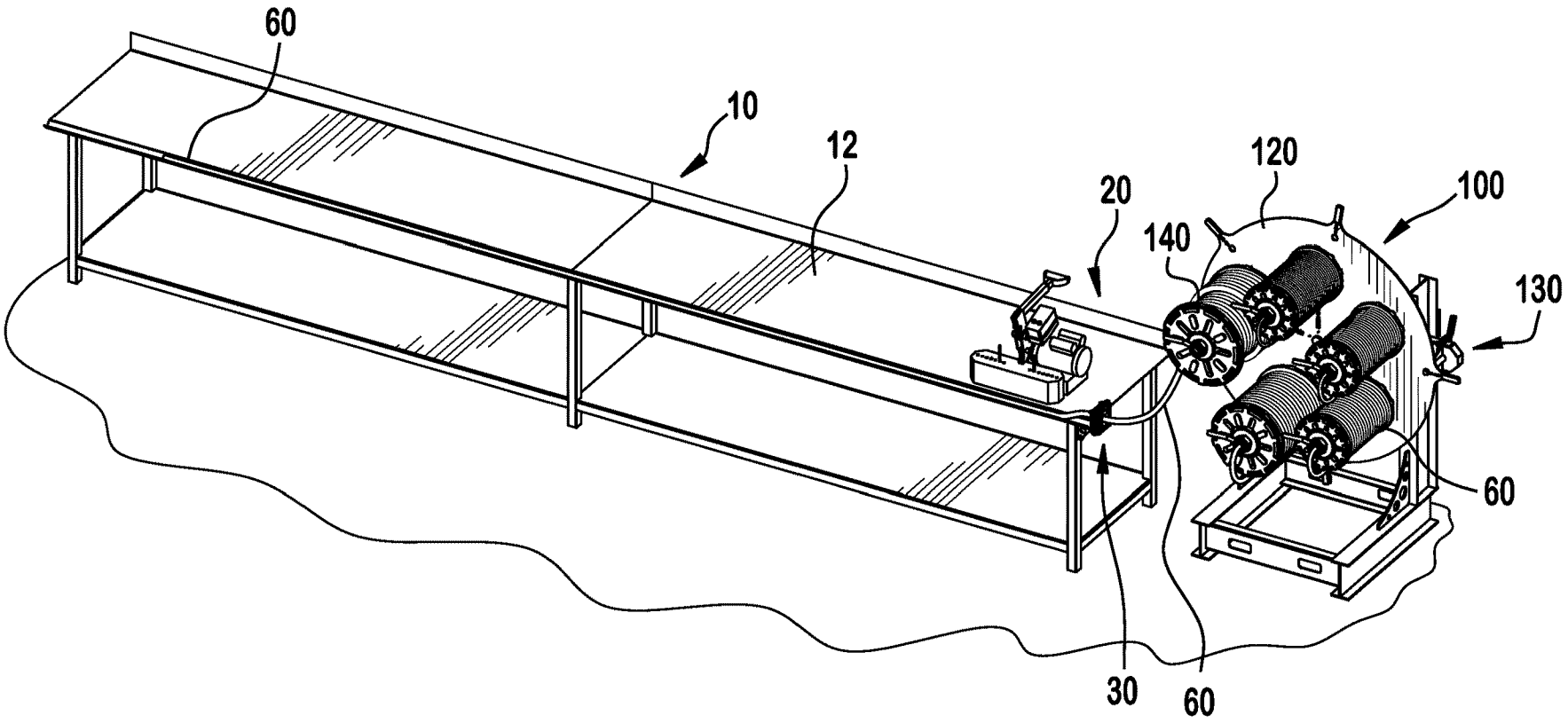
FIG. 1 is a perspective view of a hose dispensing and manufacturing system according to an embodiment of the present disclosure.
Figure 2:
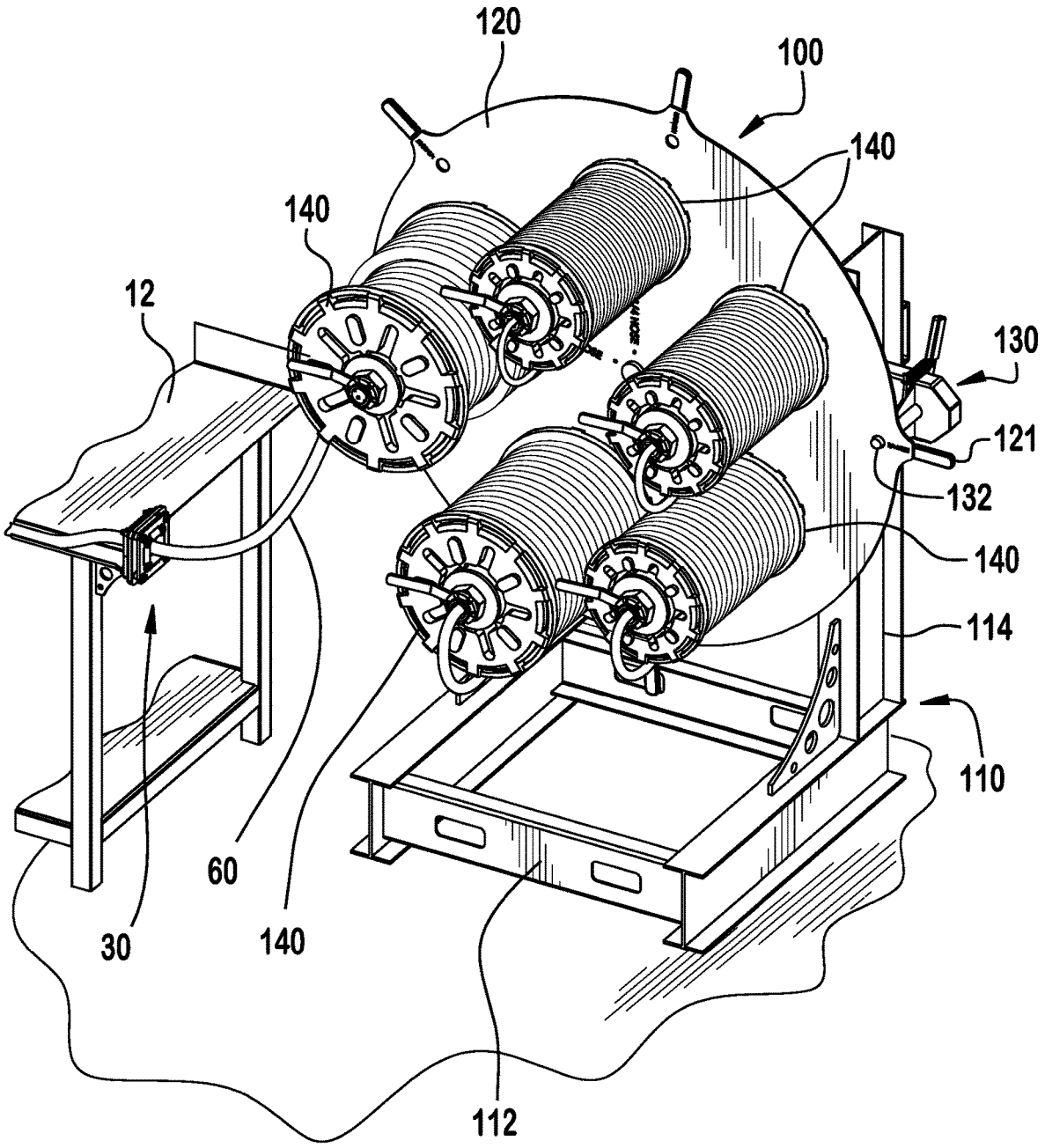
FIG. 2 is partial perspective view of a hose dispensing carousel and a hose guide of the system of FIG. 1.

It is to be understood that the figures and descriptions of the present invention have been simplified to illustrate elements that are relevant for a clear understanding of the present invention, while eliminating, for purposes of clarity, many other elements found in, for example, known systems. However, for sake of brevity and because such elements are well known in the art, and they do not facilitate a better understanding of the present invention, a discussion of such elements is not provided herein. The disclosure herein is directed to all such variations and modifications known to those skilled in the art.

In the following detailed description, reference is made to the accompanying drawings that show, by way of illustration, specific embodiments in which the invention may be practiced. It is to be understood that the various embodiments of the invention, although different, are not necessarily mutually exclusive. Furthermore, a particular feature, structure, or characteristic described herein in connection with one embodiment may be implemented within other embodiments without departing from the scope of the invention. In addition, it is to be understood that the location or arrangement of individual elements within each disclosed embodiment may be modified without departing from the scope of the invention. The following detailed description is, therefore, not to be taken in a limiting sense, and the scope of the present invention is defined only by the appended claims, appropriately interpreted, along with the full range of equivalents to which the claims are entitled. In the drawings, like numerals refer to the same or similar functionality throughout several views.

While the following description is described as a hose dispensing system, it should be understood that embodiments of the present disclosure are not limited to hoses, but may be applicable to handling of other materials or products, including flexible solid stock, other flexible conduits, rope, chain, wire and other items capable of being stored on a spool or a reel.

Referring generally to FIG. 1, a hose dispensing and processing system 10 according to embodiments of the present disclosure includes a working frame or work bench 12 having a support frame and a working surface upon which one or more manufacturing tools 20 are mounted. The tool(s) 20 may include, for example, a cutting blade for cutting a hose to length and/or a crimping tool for applying hose fittings to one or more free ends of a hose. A hose guide 30 may be fixed to the bench 12 proximate (e.g., directly adjacent to and aligned with) the tool(s) 20. The guide 30 is configured to receive a length of hose 60 dispensed from a hose dispensing carousel 100, and guide or align the hose with the tool(s) 20 for further processing. More specifically, the length of hose 60 is fed from one of a plurality of reels or spools 140 and through the hose guide 30 for processing by a user. Each of the spools 140 may store or hold different materials or products, such as hoses of different dimensions or different types of flexible elements all together. As will be set forth in greater detail therein, selective rotation of a spool support plate 120 of the carousel 100 by a user is operative to position one of the spools 140 proximate the guide 30, facilitating dispensing of the hose from the spool 140 for further processing.

Referring to FIGS. 2-6, the hose dispensing carousel 100 includes a frame 110 including a base 112 and a support section 114 extending generally vertically from the base. The spool support plate 120 is rotatably mounted to the support section 114 and is configured to hold the plurality of spools 140 that are likewise rotatably mounted thereto. The support plate 120 further comprises a plurality of radially extending protrusions or handles 121 for facilitating rotation of the plate 120 relative to the support frame 110. The rotational position of the support plate 120 may be fixed relative to the frame 110 via a lock or locking assembly 130.

Figure 4:
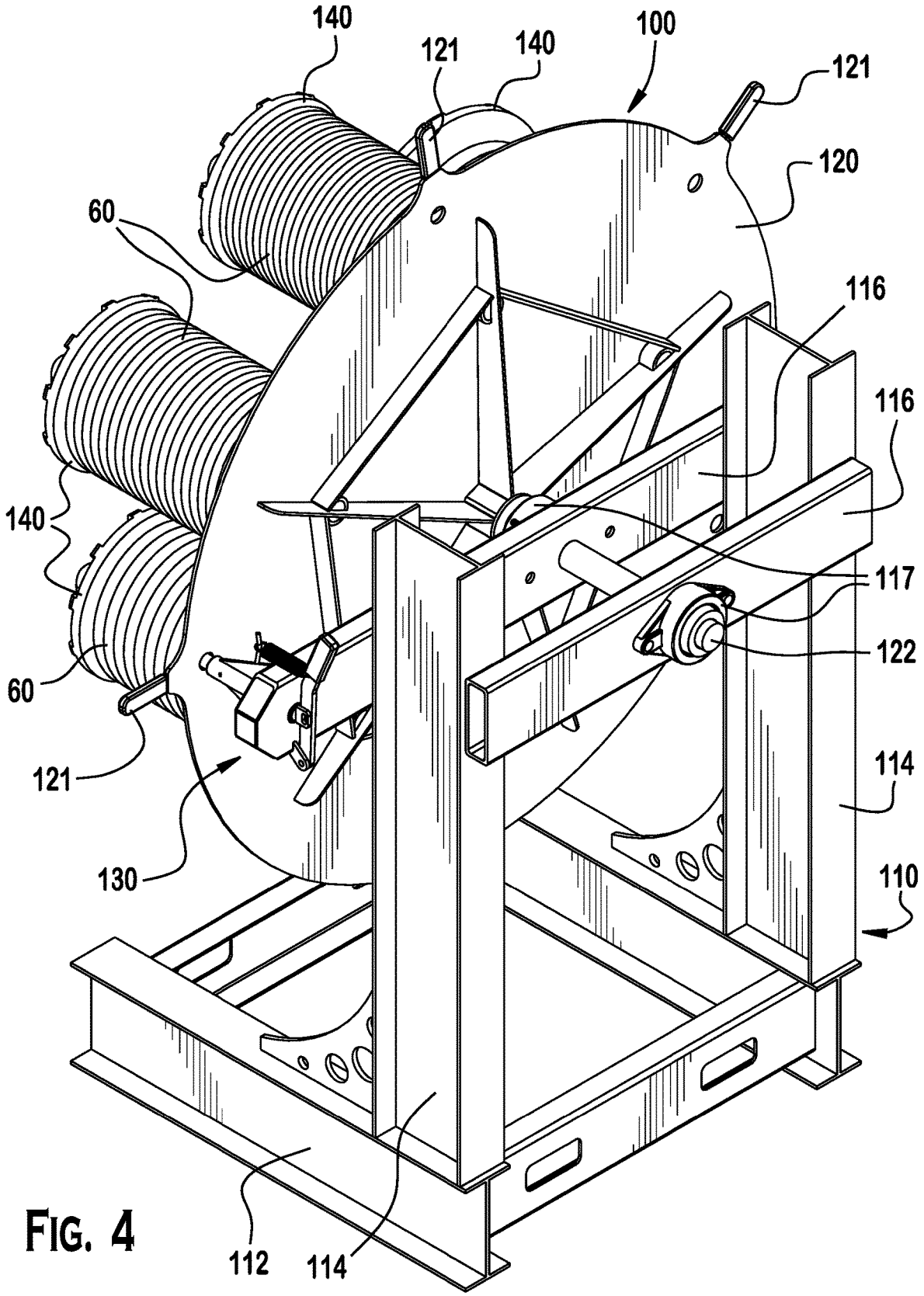
FIG. 4 is a rear perspective view of the hose dispensing carousel.
Figure 5:
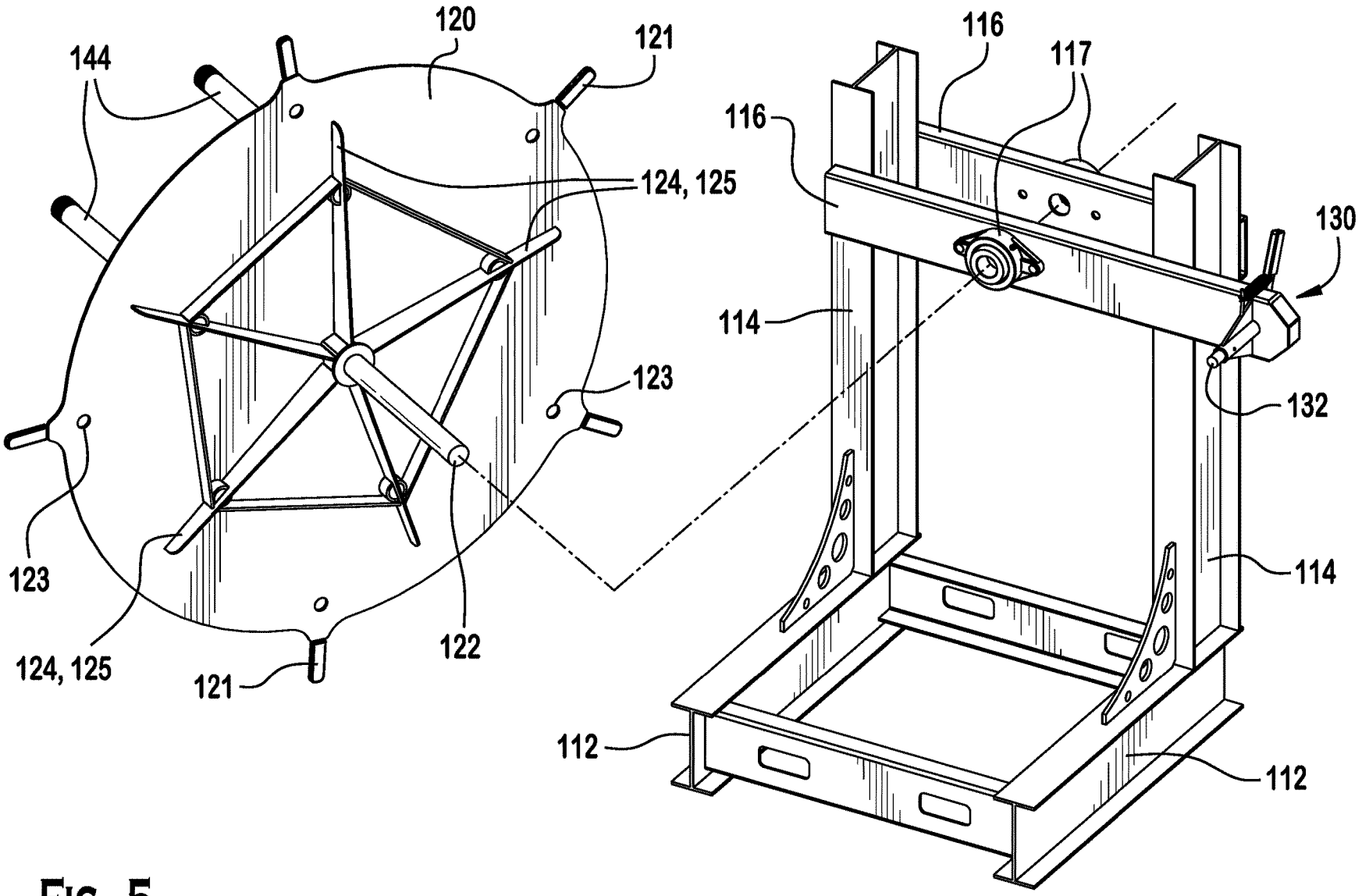
FIG. 5 is an exploded view of the hose dispensing carousel.
Figure 6:
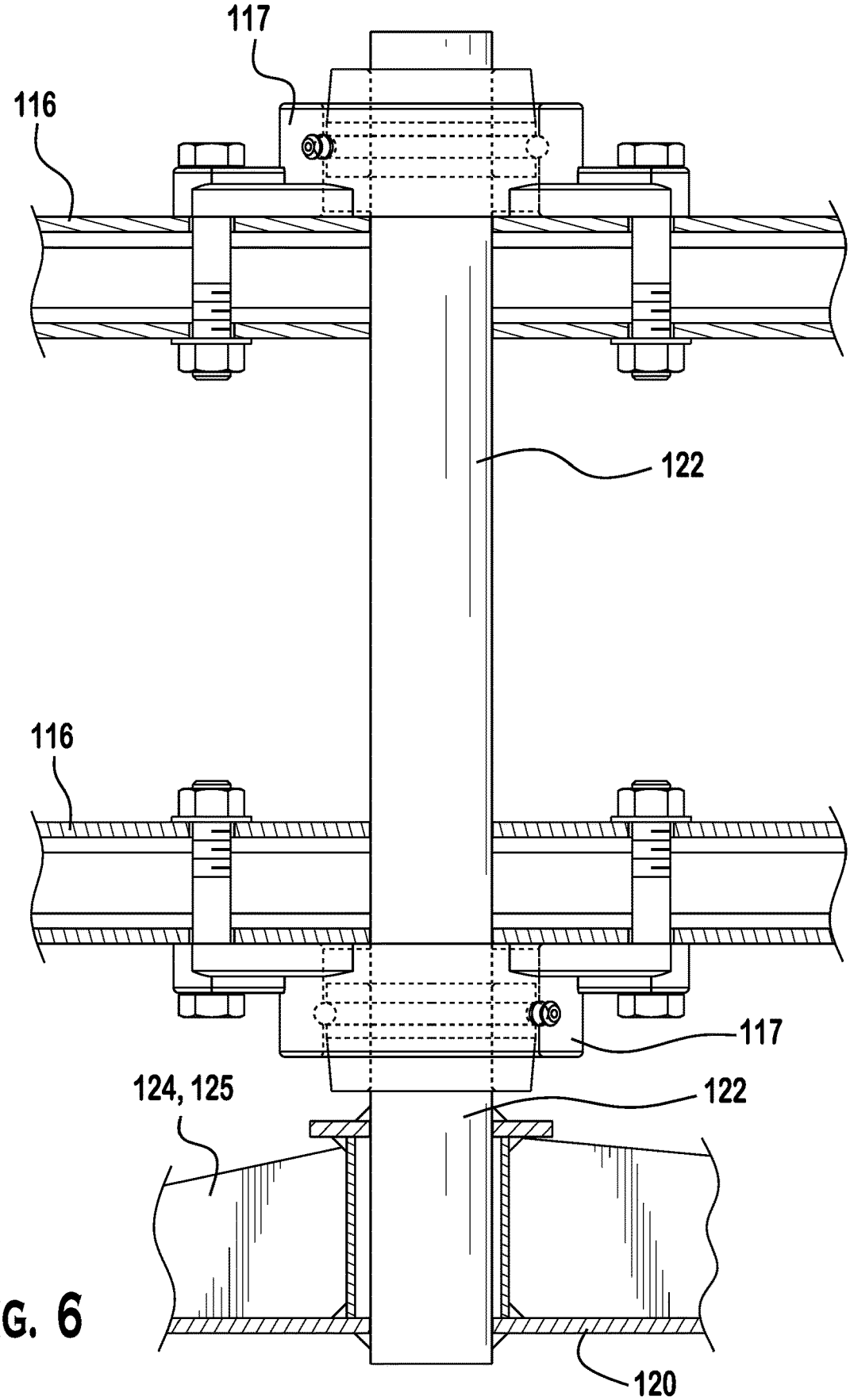
FIG. 6 is a partial cross-sectional view of the hose dispensing carousel taken along line 6-6 of FIG. 3.

As shown in FIGS. 4-6, the support section 114 includes first and second horizontal support braces 116 each having a radial flange bearing 117 attached thereto for receiving an axle 122 of the support plate 120. A subframe or stiffening element 124 is fixedly attached to a rear of the support plate 120 and is adapted to provide increased rigidity to the support plate, as well as define secure mounting points for a plurality of spool axles 144 which extend outwardly from a front side of the support plate opposite the subframe. The subframe 124 defines a plurality of arms or braces 125 extending radially outward from a center thereof, with each arm being aligned angularly with a respective one of the plurality of spool axles 144. In one embodiment, the subframe 124 and the axle 122 are formed integrally with one another, while in other embodiments, the axle may comprise a separate element fixedly attached to the subframe 124, and thus to the support plate 120.

Figure 3:
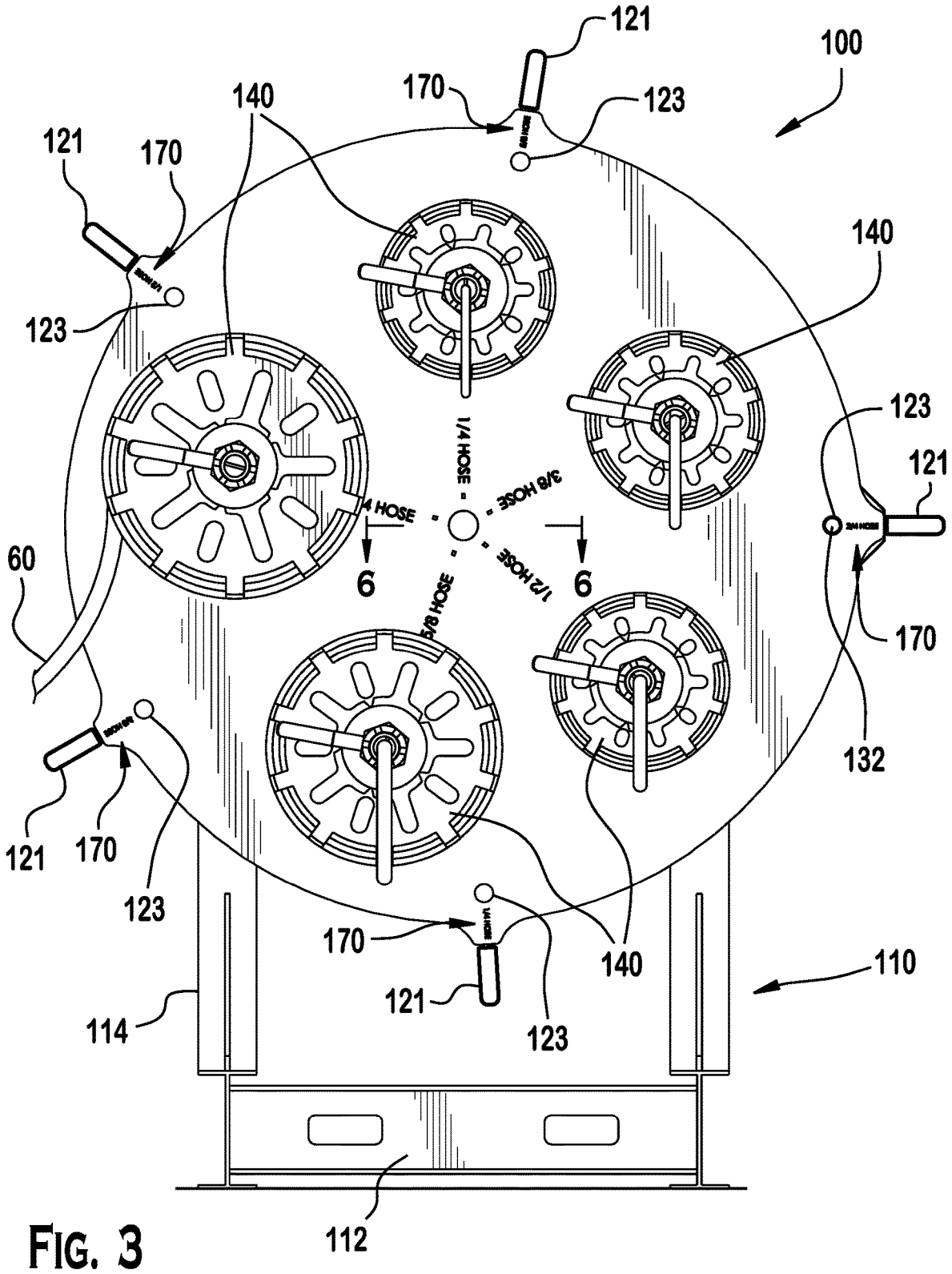
FIG. 3 is a front view of the hose dispensing carousel.
Figure 7:
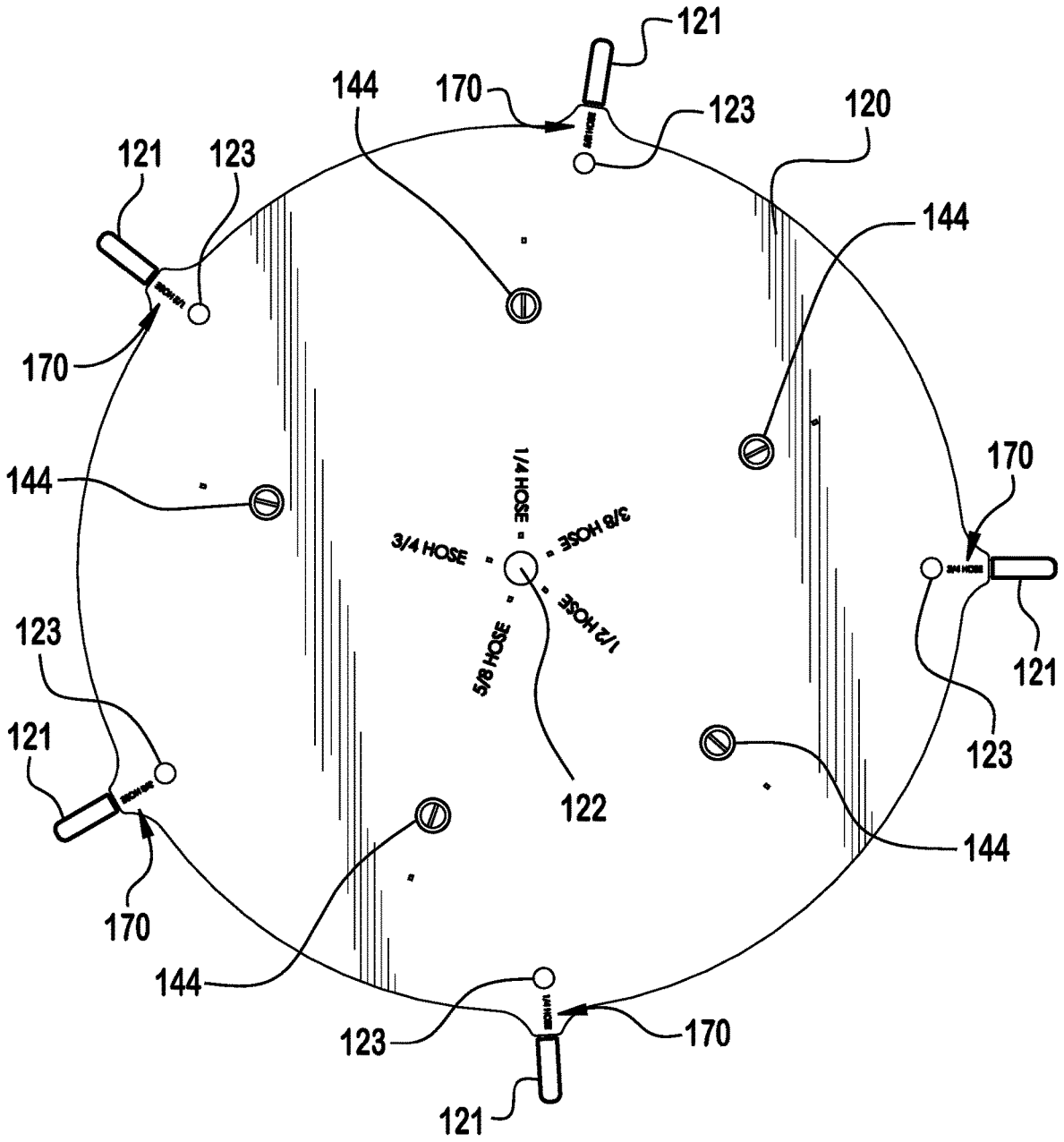
FIG. 7 is a front view of a rotatable spool support plate of the hose dispensing carousel.
Figure 7A:
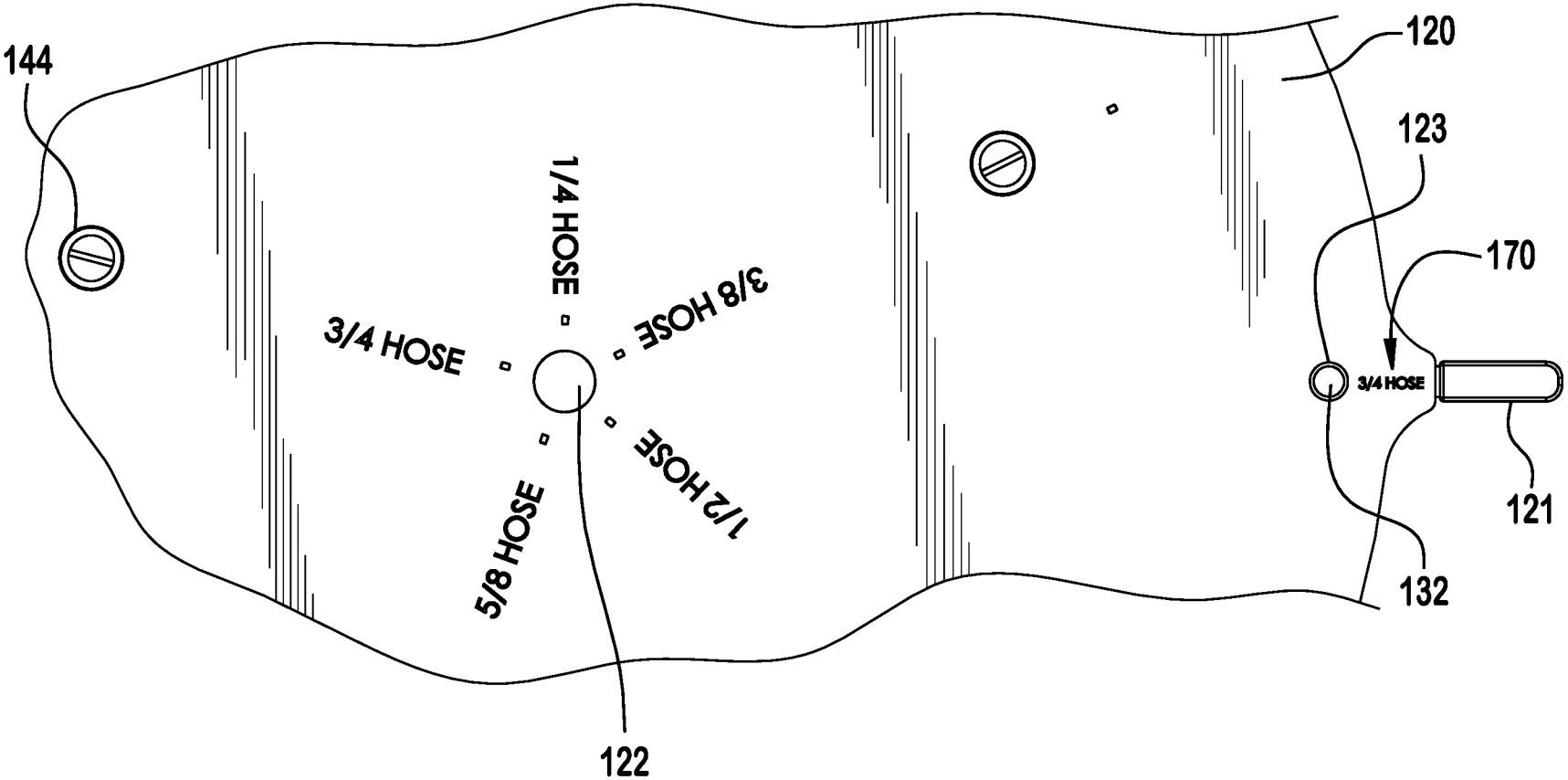
FIGS. 7A-7E are partial front views of the rotatable spool support plate of FIG. 7.
Figure 7B:
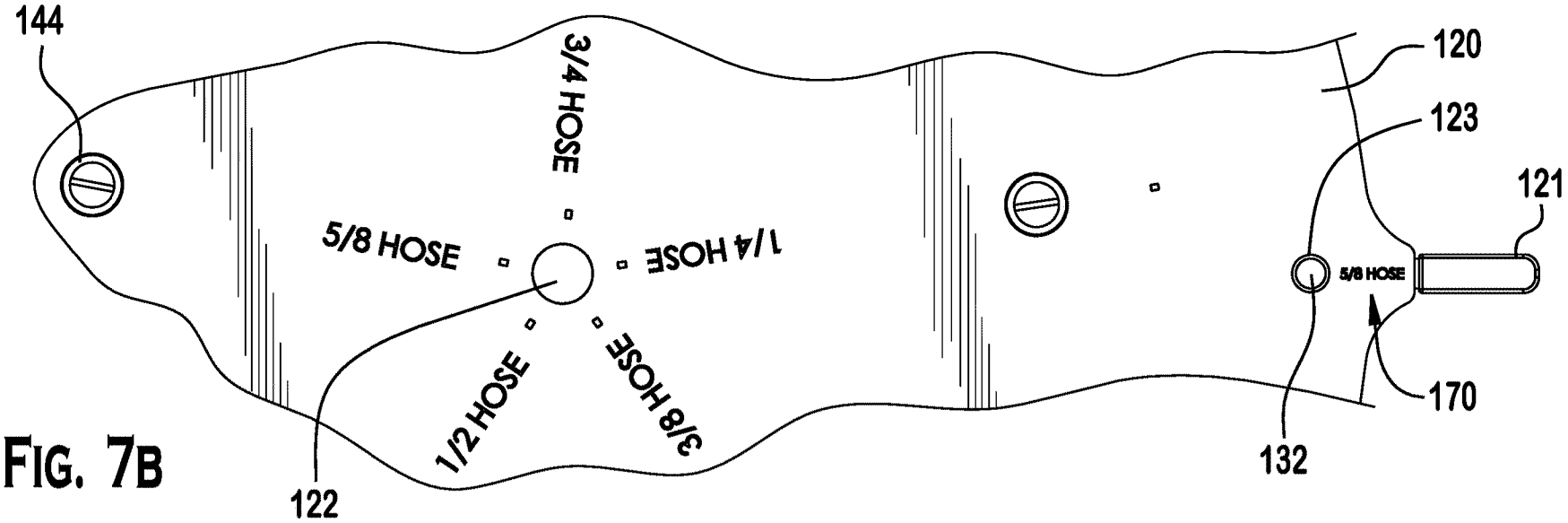
Figure 7C:
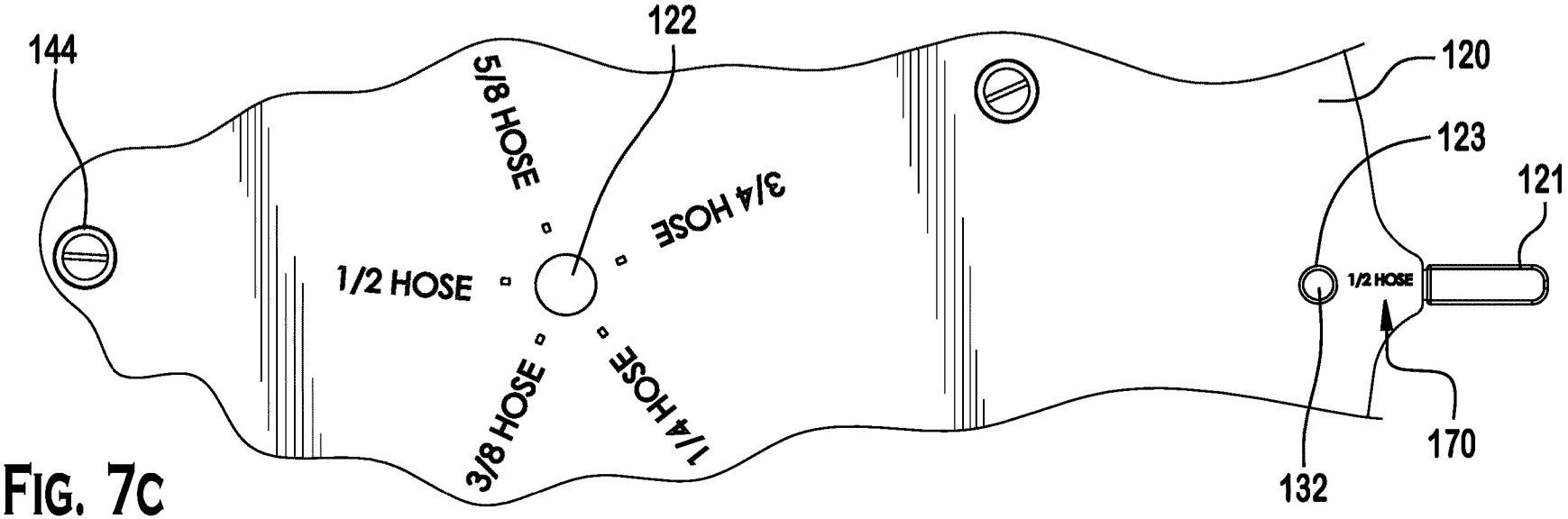
Figure 7D:
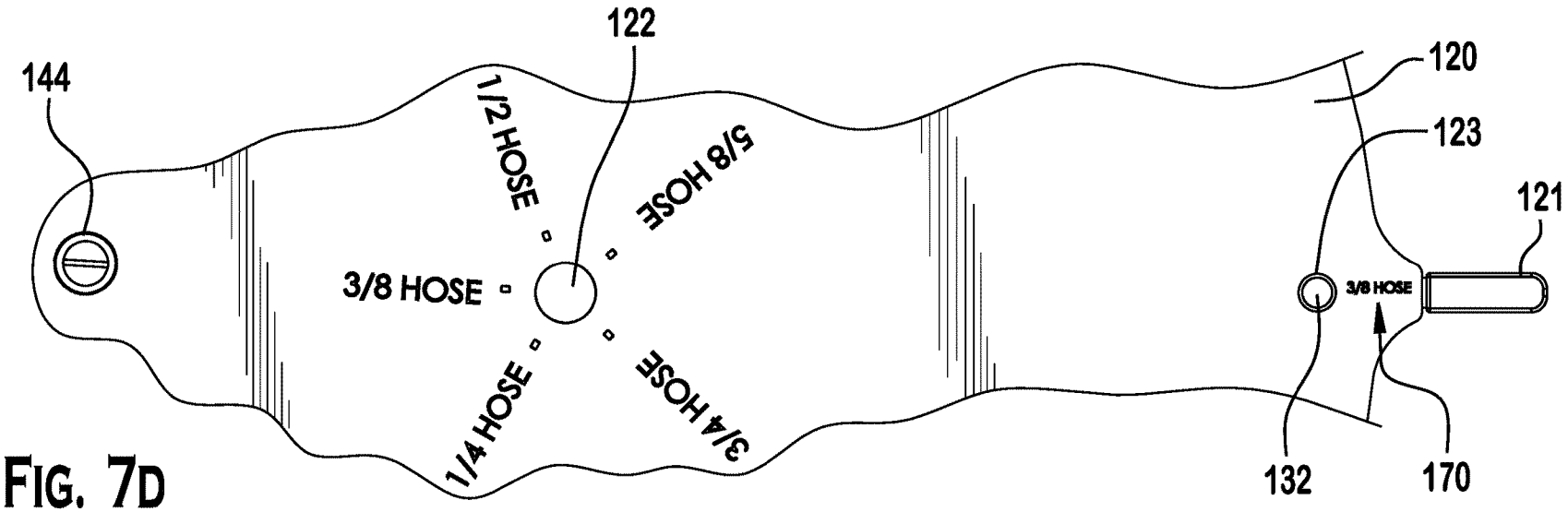
Figure 7E:
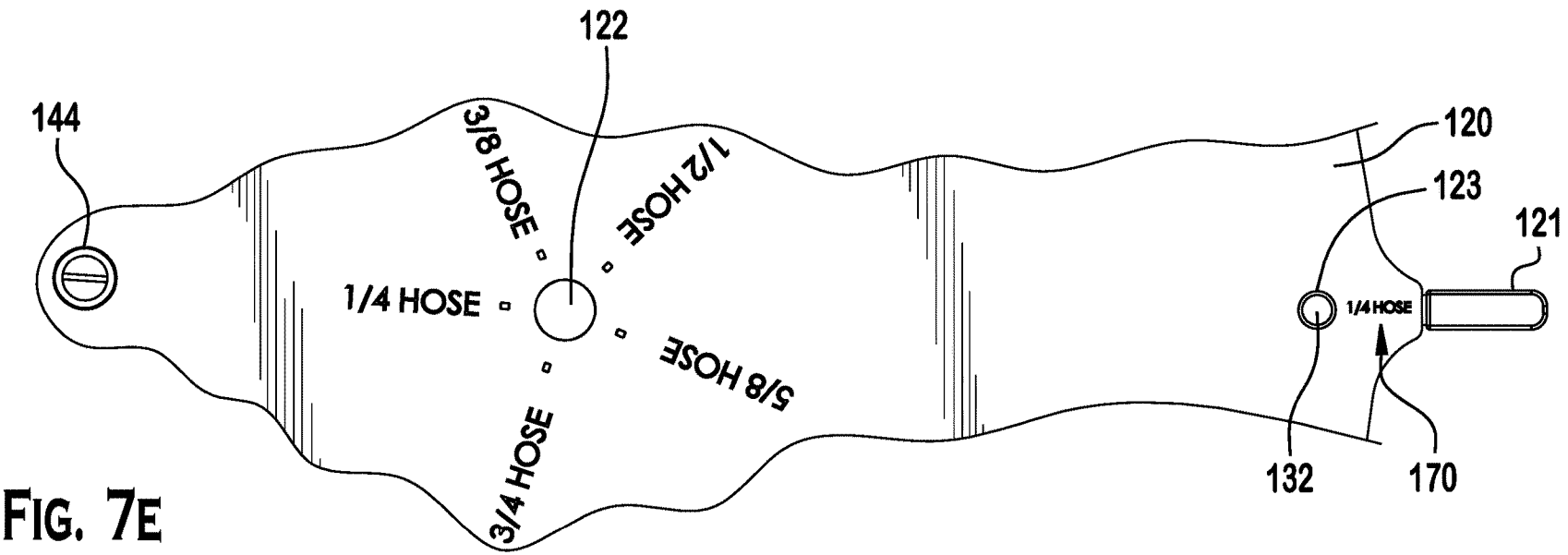

Referring to FIGS. 3 and 7-7E, an identifier 170 may be provided proximate each handle 121. The identifier 170 is associated with a particular hose contained on a corresponding spool 140, and may indicate a characteristic thereof, for example, hose size. In the exemplary embodiment, each spool or reel 140 holds a distinct diameter of hose (e.g., ¼", ⅜", ½", ⅝" and ¾"), with the identifiers 170 corresponding to the same. The position of the spool 140, and the position of the handle 121 and the identifier 170 are correlated such that, with the handle indicating a given product positioned proximate the lock 130, the spool 140 corresponding to the identified product is positioned proximate the guide 30, or other predetermined desired location, for dispensing. In some embodiments, the location of a given handle 121 and identifier 170 are not located adjacent (or in nearest proximity) to the corresponding product or spool 140 identified thereby. More specifically, in the exemplary embodiment, each spool 140 carrying a hose of a given size is arranged generally oppositely about the plate 120 relative to its corresponding handle 121 and identifier 170. In other embodiments, the handle 121 and corresponding spool 140 are radially offset approximately 5-10 degrees from being directly opposite one another, as shown in each of the FIGS. 7A-7E. This offset may be increased for an increase in a diameter of spool 140 (i.e., for a larger spool holding a larger hose), thus increasing the spacing between the spool 140 and adjacent spools. However, other configurations as possible based upon, for example, the location of the lock 130 on the support frame 110, the location of the guide 30 and/or the location of the tool(s) 20.

Figure 8:
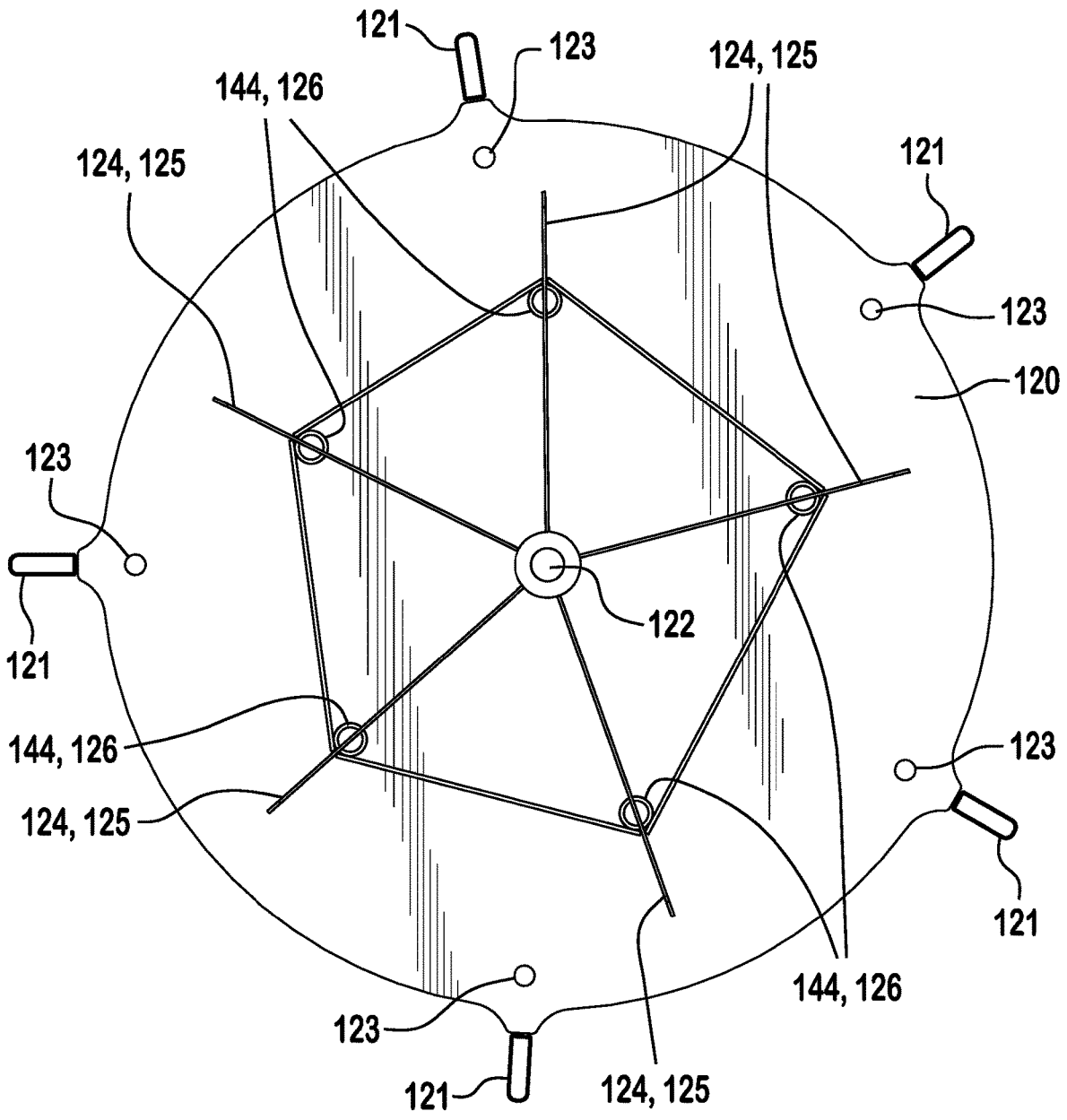
FIG. 8 is a rear view of the rotatable spool support plate of FIG. 7.
Figure 10:
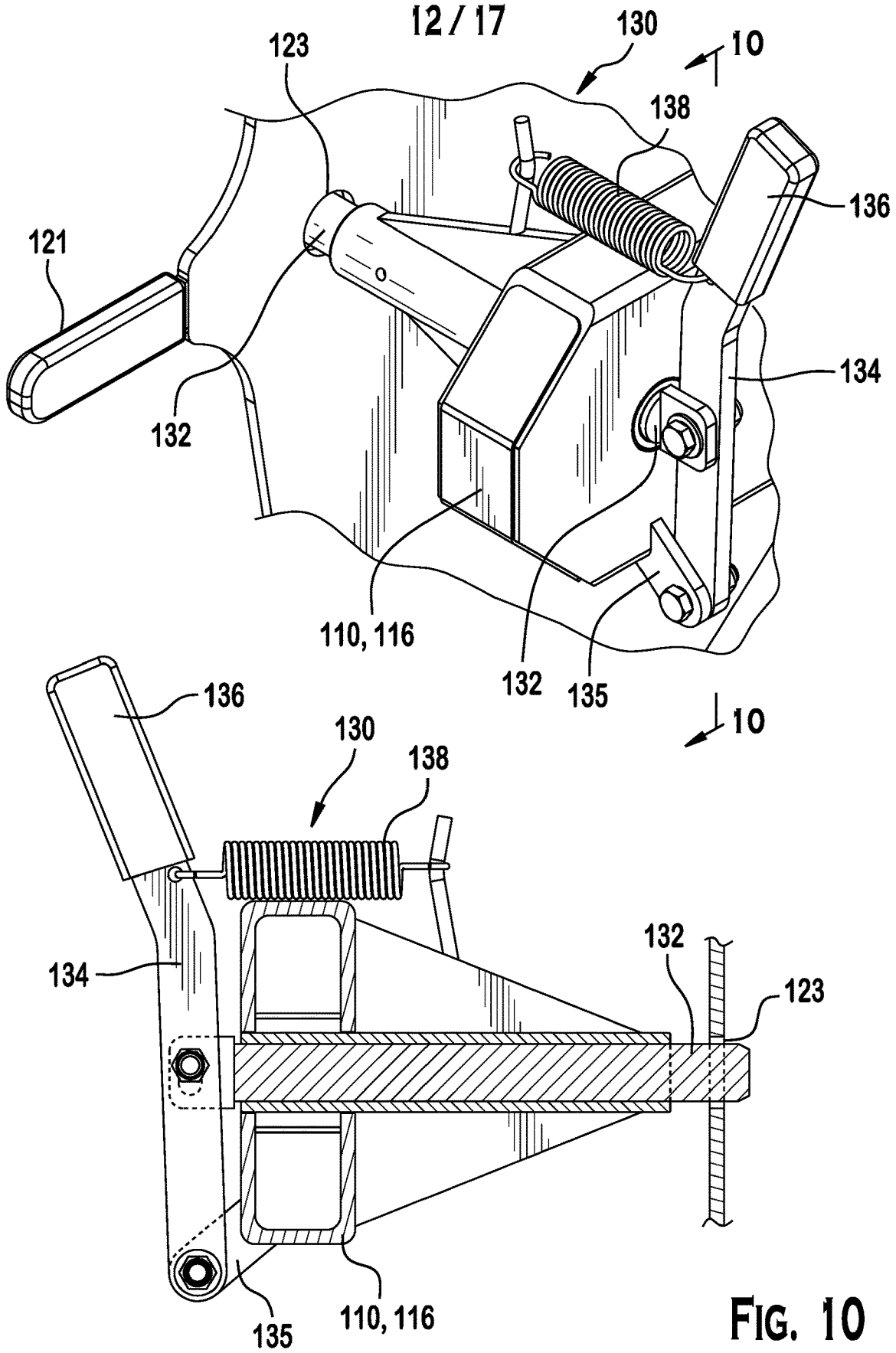
FIG. 10 is a cross-sectional view of the lock taken along line 10-10 of FIG. 9.

As illustrated in FIG. 8, in addition to the arms or braces 125, the subframe 124 may define a plurality of ring-shaped supports 126 corresponding in location to the axles 144. The supports 126 may be used to mount each axle 144 directly thereto, or may be provided to support the plate 120 in the areas associated with each axle 144. Each arm 125 extends radially beyond a corresponding mounting location associated with the axle 144, and thus beyond each support 126. In this way, the support plate 120 is supported in a manner resistance to bending moments placed thereon by the spool 140.

Still referring to FIG. 8, in the exemplary embodiment, the spool axles 144 may be arranged asymmetrically with respect to a center of the support plate 120. In one embodiment, this may include at least one axle 144 being unequally spaced in linear radial distance from the center relative to a remainder of the axles. Additionally or in the alternative, the angular spacing between axles relative to the center may be varied, such that an arc length between at least one axle and an adjacent axle is distinct from the arc lengths between other adjacent axles. In this way, the support plate 120 may be configured to provide more distance between a given axle configured to be fitted with a larger spool vs. that of adjacent axles. In other embodiments, the axles 144 may be arranged symmetrically about a center of the support plate 120. Each of these embodiments may include a correspondingly asymmetric or symmetric subframe.

As set forth above, the rotational position of the support plate 120 relative to the frame 110 is selectively fixable via the lock or lock assembly 130. The lock 130 is mounted to the support section 114 and is selectively engageable with a corresponding feature of the support plate 120. As shown in FIGS. 4, 5, 9 and 10, the lock 130 includes a moveable locking pin 132 having a free end selectively engageable with one of a plurality of openings 123 formed through the support plate 120 and corresponding in position to the location of one of the handles 121. An opposite second end of the pin 132 is attached to a handle 134. Specially, the pin 132 includes clevis end configured to receive a portion of the handle 134. The handle 134 defines a slotted opening through which a fastener is passed, securing the handle to the pin 132, while permitting the end of the pin to translate relative to the handle within the slot. A first end of the handle 134 is pivotally mounted to a bracket 135 fixed to the frame 110, with a second end fitted with a grip 136 configured to be grasped by a user. An elastic element 138, such as a tension spring, is fixed between the frame 110 and the moveable second end of the handle 134, biasing the pin 132 into a locked position.

Figure 11:
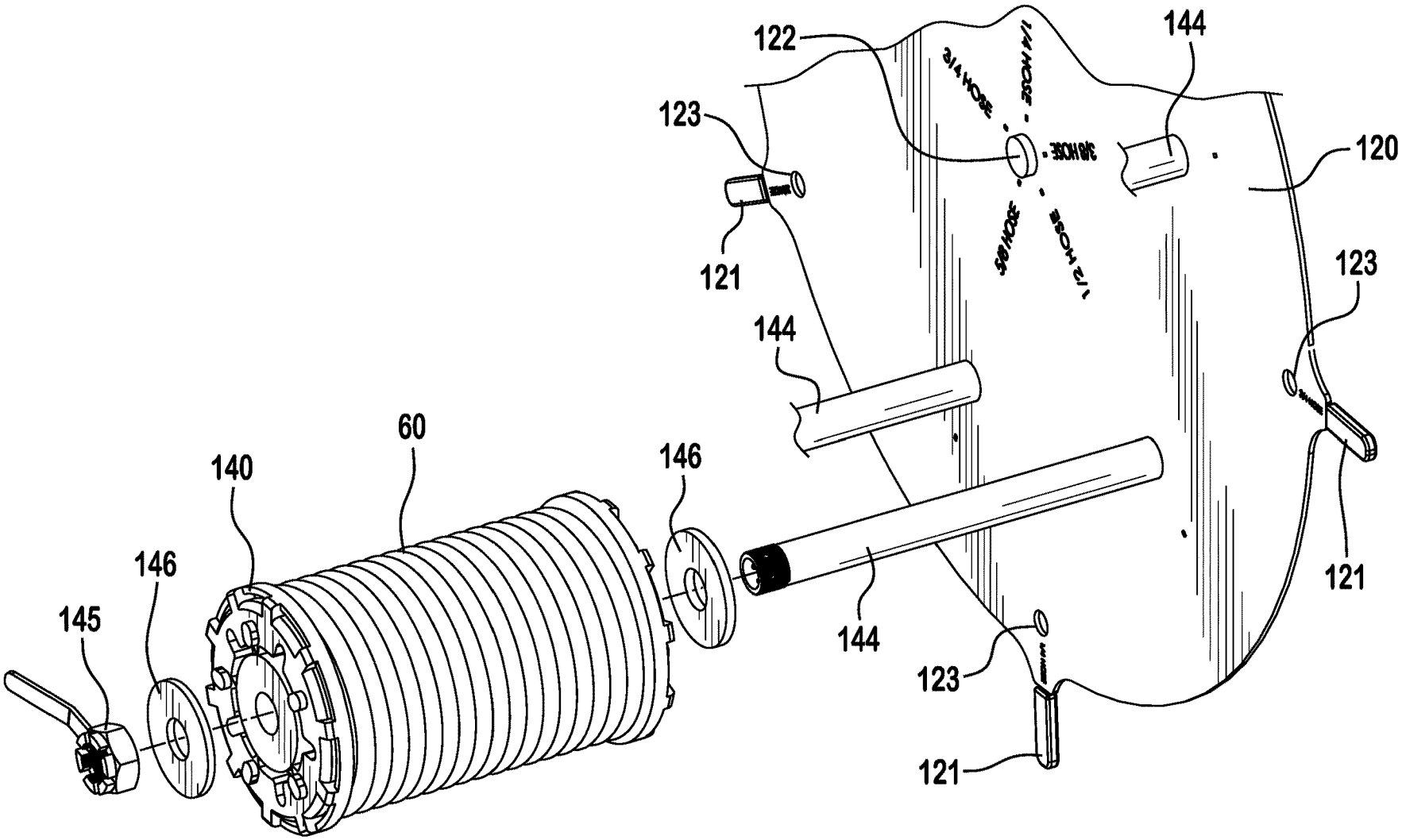
FIG. 11 is an exploded view of an exemplary spool assembly mountable to the spool support plate according to an embodiment of the present disclosure.
Figure 12:
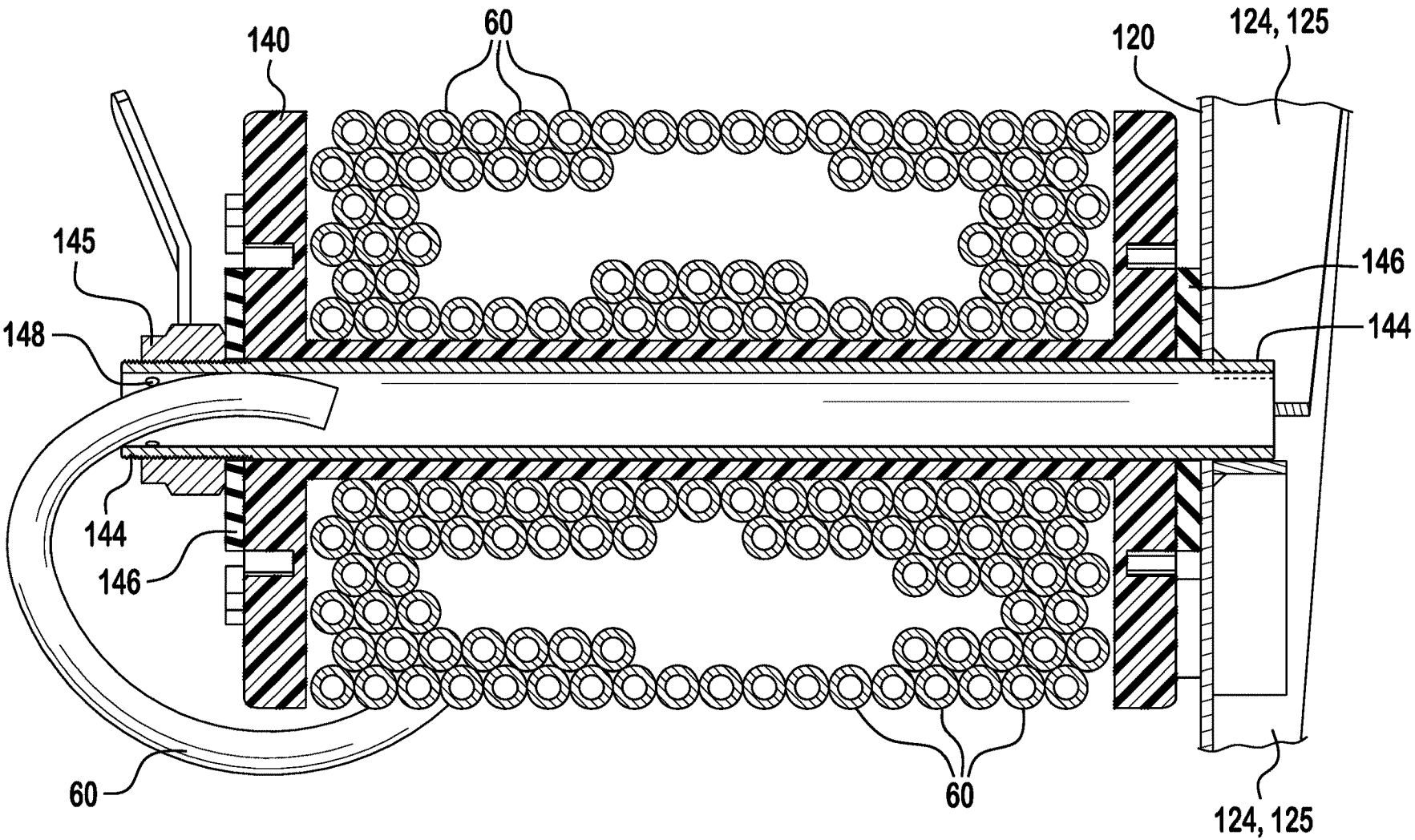
FIG. 12 is a cross-sectional view of the spool assembly of FIG. 11 in an assembled state.
Figure 13:
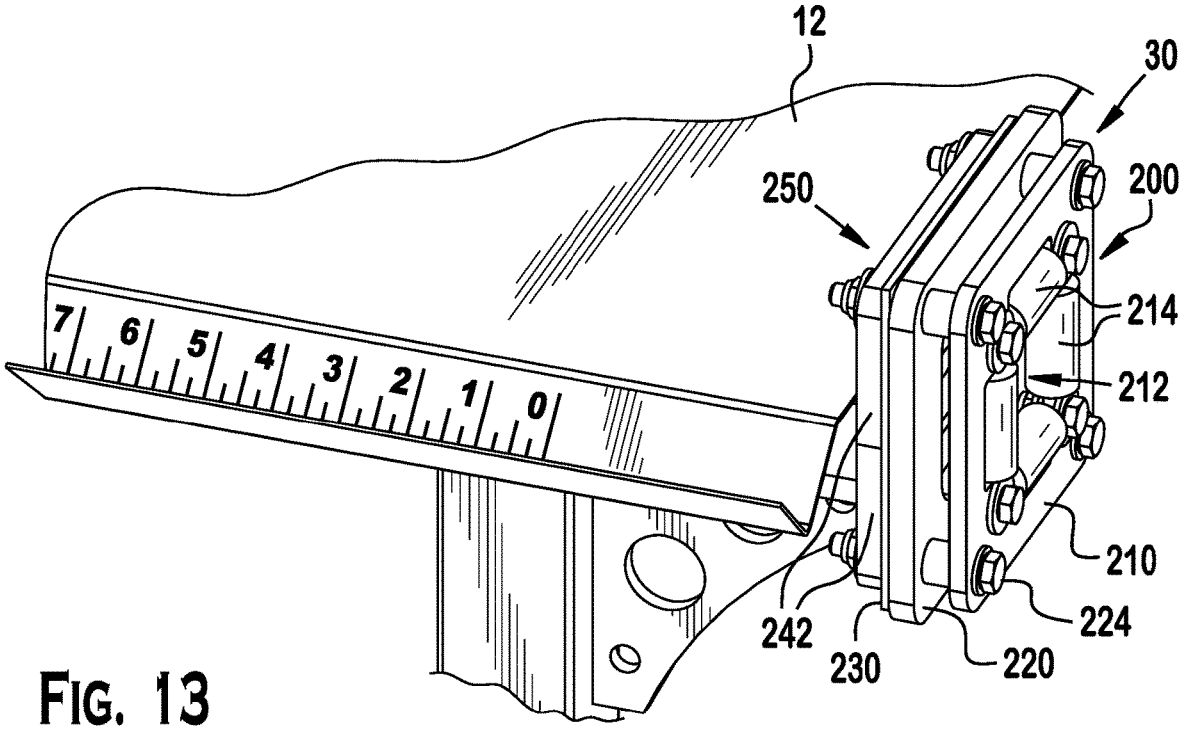
FIG. 13 is a side perspective view of a hose guide and support table according to an embodiment of the present disclosure.
Figure 14:
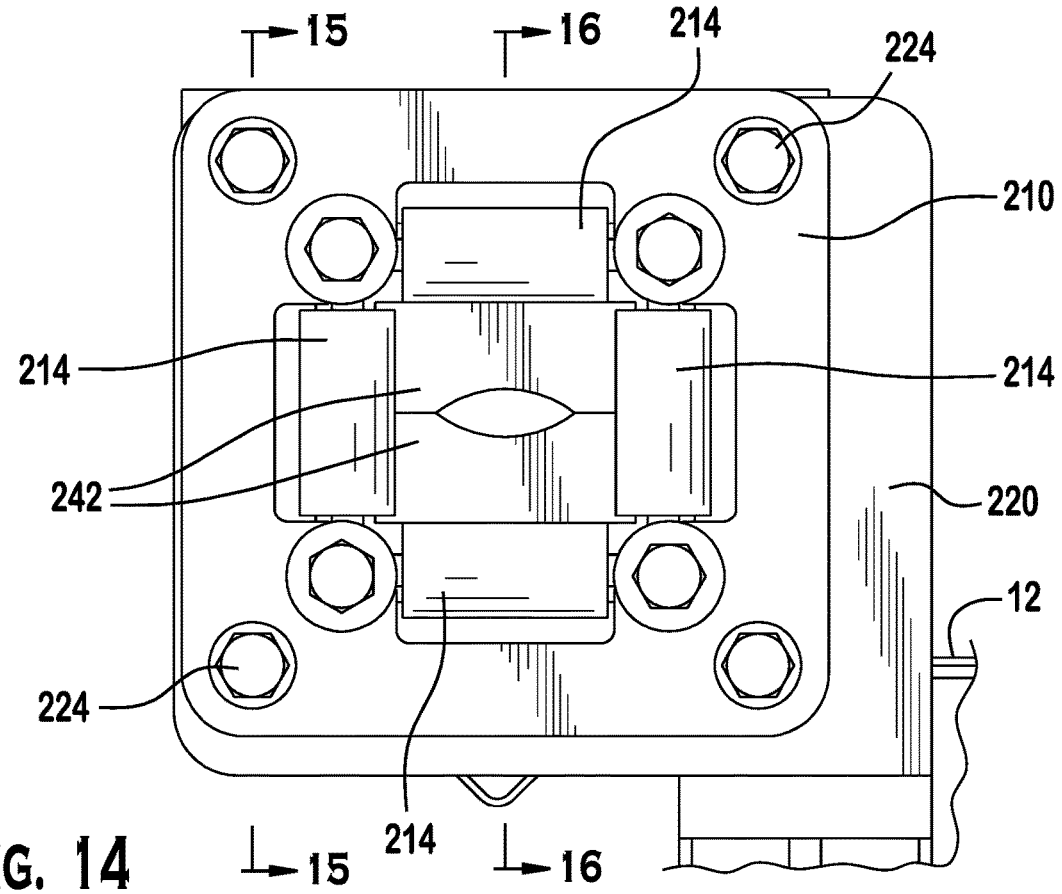
FIG. 14 is a front view of the hose guide of FIG. 13.
Figure 15:
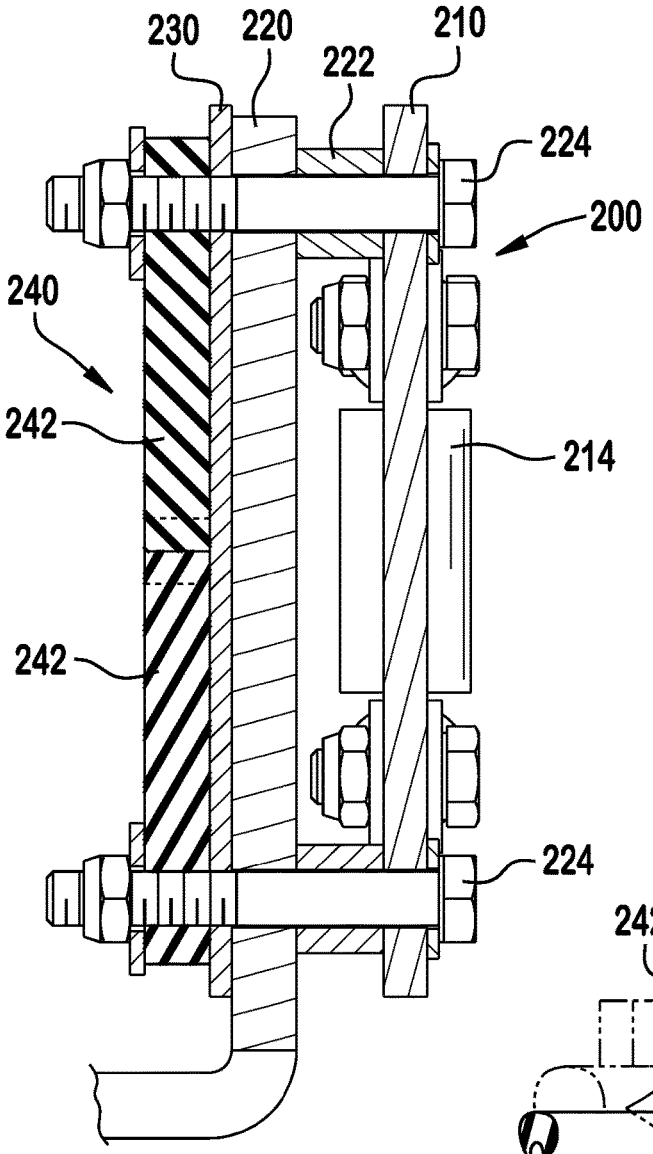
FIG. 15 is a cross-sectional view of the hose guide taken along line 15-15 of FIG. 13.

Referring to FIG. 11, as set forth above, the spools 140 are each rotatably mounted to the support plate 120 via a respective one of the axles 144. In the exemplary embodiment, ends of the axles 144 are threaded, such that with the spool 140 placed on the axle 144, a nut 145 may be threaded thereon for retaining the spool on the axle. The nut 145, which may be a castle nut, may further include a handle integrally formed thereon, allowing for easy and expedient rotation of the nut. In addition to ensuring the spool 140 is retained on the axle 144 in a rotatable manner, the nut 145 serves as a selective locking mechanism for the spool. More specifically, in use, each of the nuts 145 may be used to fix the spools radial position on the axle 144, such that it cannot inadvertently be rotated, and thus feed out or retract the hose spooled thereon unintentionally. Further, selectively tightening the nut 145 permits a user to set a specific preload, or selective resistance to rotation on the spool 140. In this way, the user is prevented from inadvertently dispensing too much material from the spool without the application of sufficient tension on the hose to overcome the preload. Washers 146 may be fitted to either side of the spool 140, acting as uniform bearing surfaces between each of the support plate 120 and the nut 145, and the spool 140. In one embodiment, the washers 146 may comprise Belleville or spring washers, further improving the ability to apply selective preload onto the spool 140 for adjusting spool tension. As shown in FIG. 12, the axle 144 is configured as a hollow element having a free end opposite the plate 120 into which a free end of the hose 60 may be fitted when not in use. The interior of the axle 144 may define one or more friction-inducing elements, such as tines or protrusions 148 which extend from an interior wall of the axle and into the opening and aid in retaining the free end of a hose 60 inserted into the opening until removal is desired by a user.

With reference now to FIGS. 13-17, a first or input end of the guide 30 comprises a bearing plate assembly 200 including generally planar bearing support plate 210 having an aperture 212 defined therethrough. In the illustrated embodiment, the aperture 212 is a four-sided rectangular opening. Arranged on each side of the aperture 212 is a rotatable bearing 214, such as a roller or cylinder rotatably mounted to the plate 210. In this way, four roller bearings 214 define an input opening to the guide 30. Each of the roller bearings 214 may be rotatably mounted on a corresponding axle or pin extending therethrough, with free ends thereof secured via fasteners to the bearing plate 210 as shown. Upon insertion, the hose 60 is guided by the low-friction roller bearings 214, preventing damage to the hose as it is passed or pulled therethrough. Notably, the presence of a rotating bearing surface on each of the input faces or sides of the opening allows for the hose 60 to enter the guide 30 from nearly any angle without incurring damage via engagement with hard edges, and/or without significant increases in friction. In this way, the guide 30 is accommodating of various alignments and positions of the hose and associated spools 140. The bearing plate 210 may be attached to a mounting bracket 220 of the guide 30 via a plurality of stand-offs or spacers 222 and associated fasteners 224. The spacers 222 prevent interference with the mounting bracket 220, ensuring the roller bearings 214 are free to rotate in the assembled state of the guide 30.

Figure 16:
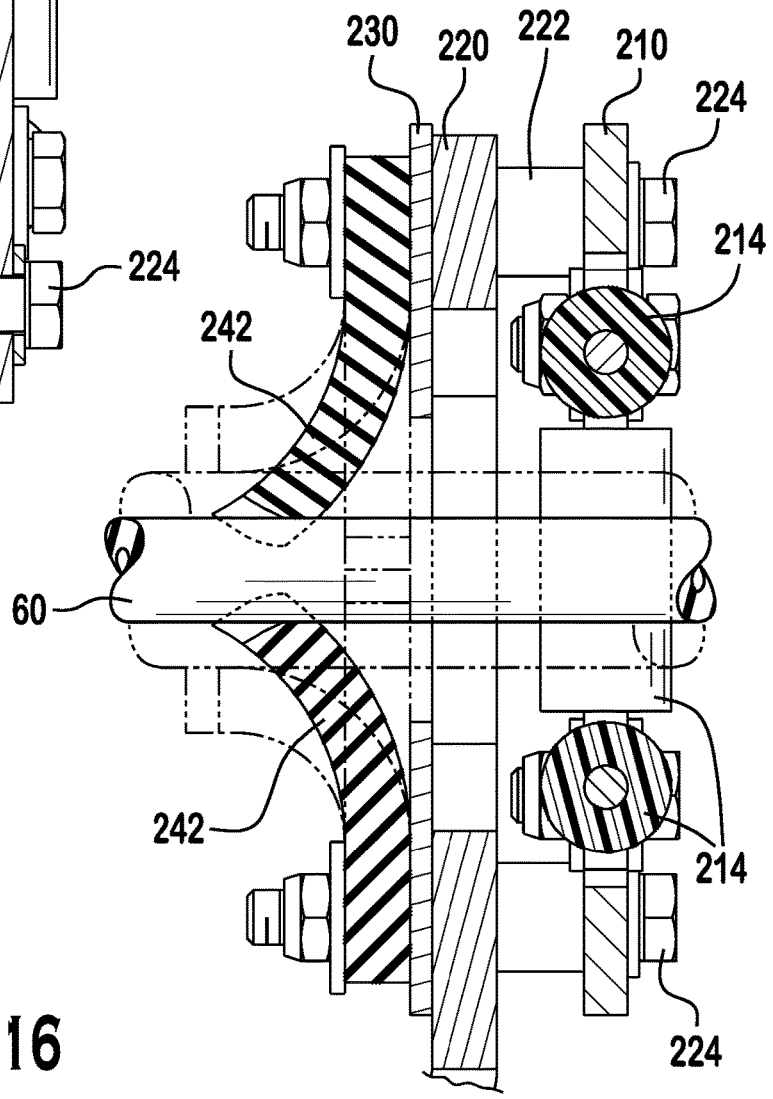
FIG. 16 is a cross-sectional view of the hose guide taken along line 16-16 of FIG. 15 in an operational state.
Figure 17:
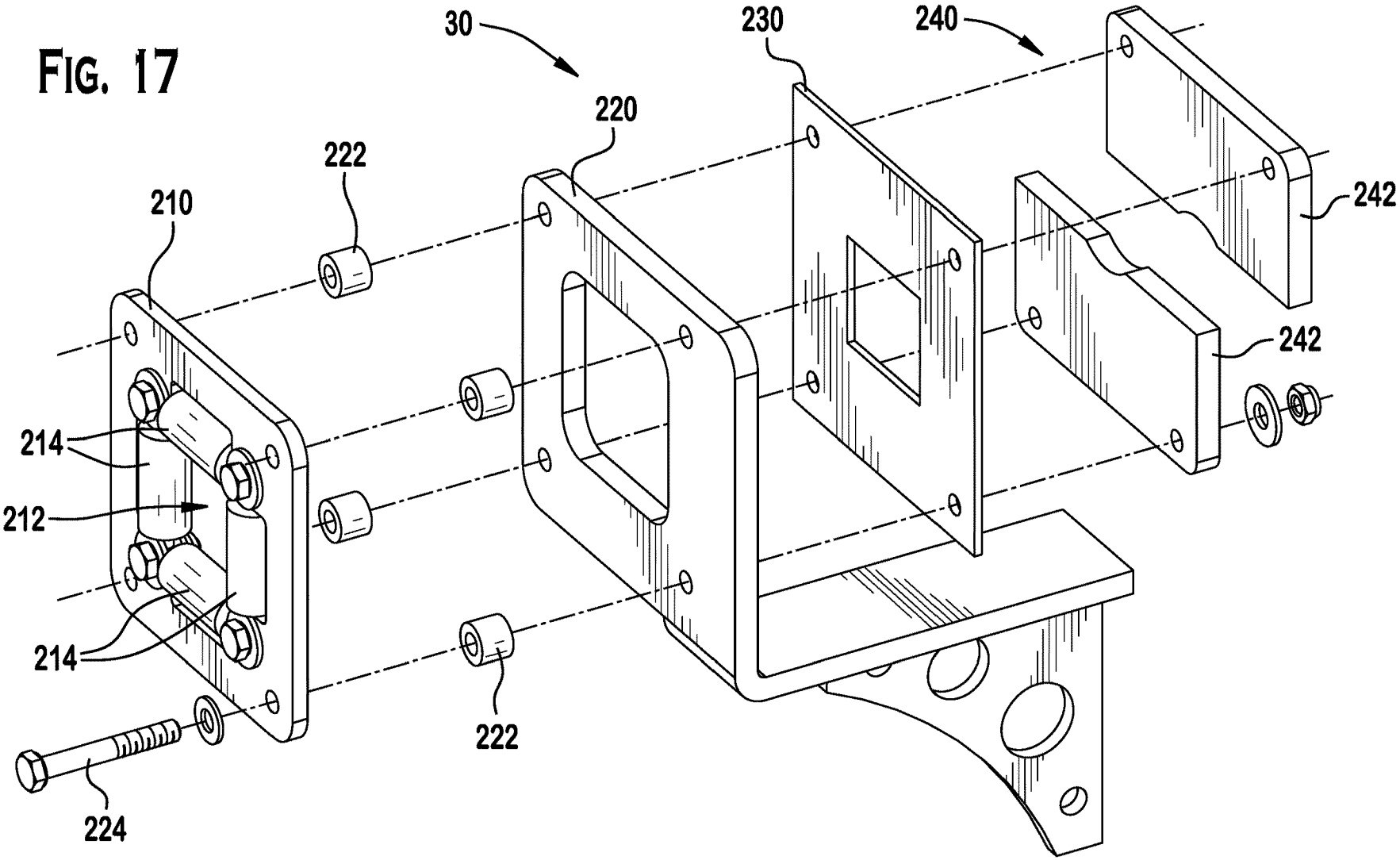
FIG. 17 is an exploded view of the hose guide of FIG. 13.

The mounting bracket 220 comprises an opening corresponding to the aperture of the bearing plate 210 through which the hose passes. On a side opposite the bearing plate may be arranged an intermediate plate 230 onto which a hose retaining element 240 is provided. In the exemplary embodiment, the retaining element 240 includes one or more elastic flaps 242 fastened thereto. The flaps 242 may comprise rubberized elements each mounted in a cantilevered manner to the outer edges of the intermediate plate 230 and the bracket 220. The elastic flaps 242 each define a portion of an aperture therethrough. In one embodiment, with each elastic flap 242 arranged generally flush or coplanar with the intermediate plate 230, the aperture is sized so as to be smaller than the hose 60. Thus, passing the hose 60 through the aperture results in the deformation of one or more of the elastic flaps 242 in an axial direction of insertion, as shown in FIG. 16. This deformation, in conjunction with friction generated between the hose 60 and the flaps 242, acts to retain the hose in position once pulled therethrough, and ensures that the hose does not pull back through, or fall out of, the guide 30 unintentionally. In this way, an operator making multiple cuts from the same hose does not have to refit the hose through the guide 30 after each cut, as it is held in place by the flaps 242. The elastic nature of the flaps 242 permits the acceptance, passage, and retention of a plurality of hose sizes, as illustrated. The bearing plate 210, intermediate plate 230 and flaps 242 may be mounted to the bracket 220 via fasteners inserted through each of these elements in the illustrated manner.

While the foregoing invention has been described with reference to the above-described embodiment, various modifications and changes can be made without departing from the spirit of the invention. Accordingly, all such modifications and changes are considered to be within the scope of the appended claims. Accordingly, the specification and the drawings are to be regarded in an illustrative rather than a restrictive sense. The accompanying drawings that form a part hereof, show by way of illustration, and not of limitation, specific embodiments in which the subject matter may be practiced. The embodiments illustrated are described in sufficient detail to enable those skilled in the art to practice the teachings disclosed herein. Other embodiments may be utilized and derived therefrom, such that structural and logical substitutions and changes may be made without departing from the scope of this disclosure. This Detailed Description, therefore, is not to be taken in a limiting sense, and the scope of various embodiments is defined only by the appended claims, along with the full range of equivalents to which such claims are entitled.

Such embodiments of the inventive subject matter may be referred to herein, individually and/or collectively, by the term "invention" merely for convenience and without intending to voluntarily limit the scope of this application to any single invention or inventive concept if more than one is in fact disclosed. Thus, although specific embodiments have been illustrated and described herein, it should be appreciated that any arrangement calculated to achieve the same purpose may be substituted for the specific embodiments shown. This disclosure is intended to cover any and all adaptations of variations of various embodiments. Combinations of the above embodiments, and other embodiments not specifically described herein, will be apparent to those of skill in the art upon reviewing the above description.

What is claimed is:

1. A system for dispensing a flexible hose, comprising:

a hose dispensing carousel including:

a frame;

a spool support plate rotatably mounted to the frame and having a plurality of spool axles for rotatably supporting a plurality of spools of hose; and a lock adapted to fix a position of the spool support plate relative to the frame in a plurality of discrete positions; and a guide defining an opening adapted to receive a free end of a hose held on one of the plurality of spools therethrough, the guide defining at least one bearing surface positioned at the opening.

2. The system of claim 1, wherein the spool support plate further includes a subframe fixedly mounted thereto and including:

an axle rotatably mounted to the frame; and a plurality of support arms extending radially from a center of the spool support plate in directions corresponding to the positions of each of the plurality of spool axles.

3. The system of claim 1, wherein the spool support plate further defines a plurality of handles arranged radially about the perimeter of the support plate.

4. The system of claim 3, furthering comprising a plurality of indicia associated with each of the plurality of handles and identifying a characteristic of a hose held by a corresponding one of the plurality of spool axles, wherein the position of the handle is correlated with the position of the corresponding spool axle.

5. The system of claim 1, wherein the lock includes a spring-biased pin moveably mounted to the frame, a free end of the pin configured to be inserted into one of a plurality of correspondingly sized holes defined in the spool support plate, wherein each of the plurality of openings correspond to one of the plurality of discrete positions of the support plate and correspond in location to one of the plurality of handles.

6. The system of claim 1, further comprising a plurality of spool assemblies, each spool assembly configured to be rotatably supported on one of the plurality of spool axles and comprising:

a spool body adapted to receive one of the plurality of spool axles therethrough; and a fastener configured engage with the spool axle and selectively apply a compressive force on the spool body in an axial direction of the axle.

7. The system of claim 6, wherein the fastener comprises a nut threaded on a free end of the axle.

8. The system of claim 1, wherein free ends of each of the plurality of spool axles comprise a hollow openings configured to receive a free end of a hose wound on a spool supported by the axle.

9. The system of claim 1, wherein the guide includes a plurality of bearing surfaces positioned thereabout the opening.

10. The system of claim 9, wherein each bearing surface comprises a roller bearing, the plurality of roller bearings bordering a perimeter of the opening.

11. The system of claim 10, wherein the guide further comprises a retaining element configure to receive a hose passing through the opening in the guide and resist movement of the hose through the guide once received.

12. The system of claim 11, wherein the retaining element comprises an elastic element configured to be deflected by the hose.

13. The system of claim 12, wherein the retaining element comprise a first elastic flap and a second elastic flap configured to be resiliently biased by the hose as it passes through an opening defined between the flaps and hold the hose therebetween under the force of friction.

14. The system of claim 11, wherein the at least one bearing surface of the guide is mounted to a bearing plate defining an input opening of the guide, wherein the guide further comprises a mounting bracket, wherein the bearing plate is arranged on a first side of the mounting bracket and the retaining element is arranged on a second side of the mounting bracket opposite the bearing plate.

15. The system of claim 1, further comprising:

a working frame, wherein the guide is fixedly mounted to the working frame; and a tool adapted to perform a manufacturing operation on the hose, the tool fixedly mounted on the working frame and having a working area generally aligned with the opening of the guide.

16. A hose dispensing carousel comprising:

a frame;

a spool support plate rotatably mounted to the frame;

a plurality of spool axles mounted to the spool support plate;

a plurality of spools, each of the plurality of spools selectively rotatably mounted on a respective one of the plurality of spool axles;

a plurality of fasteners each configured to selectively fix a respective spool relative to a respective spool axle; and a lock adapted to fix a position of the spool support plate relative to the frame in a plurality of discrete positions.

17. The carousel of claim 16, wherein the spool support plate further includes a subframe fixedly mounted thereto and including an axle rotatably mounted to the frame and a plurality of support arms extending radially from a center of the spool support plate in directions corresponding to the positions of each of the plurality of spool axles.

18. The carousel of claim 16, wherein the plurality of spool axles are arranged asymmetrically with respect to a center of the support plate.

19. The carousel of claim 16, wherein the spool support plate further comprises:

a plurality of handles arranged radially about the perimeter of the support plate; and a plurality of indicia associated with each of the plurality of handles and identifying a characteristic of hose held by a corresponding one of the plurality of spool axles, wherein the position of the handle is correlated with the position of the corresponding spool axle.

* * * * *